US006854956B2

(12) United States Patent
Miwata et al.

(10) Patent No.: US 6,854,956 B2
(45) Date of Patent: Feb. 15, 2005

(54) TURBO-MOLECULAR PUMP

(75) Inventors: Tooru Miwata, Narashino (JP); Satoshi Okudera, Narashino (JP); Yoshiyuki Sakaguchi, Narashino (JP); Yasushi Maejima, Narashino (JP)

(73) Assignee: BOC Edwards Technologies Limited, Narashino (JP)

( * ) Notice: Subject to any disclaimer, the term of this patent is extended or adjusted under 35 U.S.C. 154(b) by 1 day.

(21) Appl. No.: 10/387,058

(22) Filed: Mar. 12, 2003

(65) Prior Publication Data

US 2003/0175113 A1 Sep. 18, 2003

(30) Foreign Application Priority Data

Mar. 12, 2002 (JP) ..... 2002-067040
Feb. 4, 2003 (JP) ..... 2003-027370

(51) Int. Cl.[7] ..... F01D 1/36
(52) U.S. Cl. ..... 415/90; 415/143
(58) Field of Search ..... 415/90, 55.1, 143

(56) References Cited

U.S. PATENT DOCUMENTS 4,655,678 A * 4/1987 Miki ..... 415/71
5,417,551 A * 5/1995 Abe et al. ..... 417/203
6,485,254 B1 * 11/2002 Davis ..... 415/9
6,498,410 B1 * 12/2002 Yashiro et al. ..... 310/90
6,575,713 B2 * 6/2003 Ohtachi et al. ..... 417/353
6,664,683 B1 * 12/2003 Yashiro et al. ..... 310/90

* cited by examiner

*Primary Examiner*—Hoang Nguyen
(74) *Attorney, Agent, or Firm*—Adams & Wilks

(57) ABSTRACT

A turbo-molecular pump has a main body and a pump case for covering the main body. A first flange is integrally formed with the pump case for connection to a second flange integrally with a vacuum chamber. The flange of the pump case and the flange of the vacuum chamber are integrally connected together with fastening bolts. A clamping structure separately clamps the first and second flanges together by surrounding a portion of each of the first and second flanges.

20 Claims, 12 Drawing Sheets

PRIOR ART

TURBO-MOLECULAR PUMP

BACKGROUND OF THE INVENTION

1. Field of the Invention

The present invention relates to turbo-molecular pumps used in semiconductor manufacturing apparatus, an electronic microscope, a surface analysis apparatus, a mass spectrograph, a particle accelerator, a nuclear fusion experiment apparatus, and so forth, and more particularly, the present invention relates to a turbo-molecular pump in which its connecting portion with a vacuum chamber is improved.

2. Description of the Related Art

In a process such as dry etching, chemical vapor deposition (CVD), or the like performed in a high-vacuum process chamber in semiconductor manufacturing step, a vacuum pump such as a turbo-molecular pump is used for producing a high vacuum in the process chamber by exhausting gas from the process chamber, as shown in, for example, Japanese Unexamined Patent Application Publication No. 20001-291586.

FIG. 12 illustrates a conventional turbo-molecular pump used for the above purposes. The turbo-molecular pump shown in FIG. 12 is a composite pump having a turbo-molecular pump unit and a groove pump unit.

As shown in FIG. 12, the turbo-molecular pump has a rotor 42 having a plurality of rotor blades 41 and a rotor shaft 43 integrally fixed to the rotor 42 along the rotation center axis thereof, both being housed in a pump case 1, so as to form a high-speed rotating body. The rotor shaft 43 is rotatable supported by upper and lower magnetic bearings 46 which are disposed between the rotor shaft 43 and a stator column 45 disposed so as to be erected at the lower part of a pump base 44 for supporting the pump case 1 and also by a magnetic bearing 46S which is disposed between the pump base 44 and the rotor shaft 43. The high-speed rotating body rotates at a high speed of about 400 m/s with respect to the peripheral velocity of the rotor blades, driven by a drive motor 47 which is incorporated between the upper and lower magnetic bearings 46 and between the stator column 45 and the rotor shaft 43.

While rotating at such a high speed, by inhaling gas from a gas suction port 48 disposed above the rotor 42 and then by exhausting it from a gas vent 49 disposed below the rotor 42, the turbo-molecular pump produces a high vacuum in a vacuum chamber 3 connected to the gas suction port 48 with flanges 2 and 4 in a semiconductor manufacturing process or the like.

The above-mentioned evacuating operation is performed by a turbo-molecular pump mechanism portion A and a groove pump mechanism portion B, that is, upper and lower parts of the turbo-molecular pump, respectively.

More particularly, the turbo-molecular pump mechanism portion A is formed by the plurality of rotor blades 41 and a plurality of stator blades 50 fixed to the pump case 1 such that the rotor blades 41 and the stator blades 50 are alternately disposed. With this structure, gas molecules from the gas suction port 48 in a high vacuum is sent downwards in the figure by the interaction between the high-speed rotating rotor blades 41 and the stationary stator blades 50 so as to perform an exhausting operation.

The groove pump mechanism B is formed by a rotating cylindrical surface 42*b*, that is, the outer peripheral surface of a skirt portion 42*a* serving as a lower half of the rotor 42 and by a threaded stator 51 fixed in the pump case 1 so as to closely surround the rotating cylindrical surface 42*b*. With this structure, the gas molecules sent from the turbo-molecular pump mechanism portion A to spiral thread grooves 52 carved on the inner surface of the threaded stator 51 is sent into the gas exhaust port 49 along the thread grooves 52 by the rotating cylindrical surface 42*b* of the skirt portion 42*a* of the rotor 42 rotating at high speed so as to perform an exhausting operation of the gas in a relatively low degree of vacuum.

The rotor blades 41, the rotor 42, the stator blades 50, the chamber 3 connected to the gas suction port 48, and the like are usually composed of a light alloy, especially an aluminum alloy among others since the aluminum alloy has good machinability and is thus easily and precisely processed. Meanwhile, the aluminum alloy has a relatively small strength and sometimes causes a creep fracture depending on its use conditions.

Among the above-mentioned components, the rotor blades 41 and the rotor 42 integrally formed with the rotor blades 41 undergo a dynamic balancing operation during their assembling process in order to withstand a high-speed rotation. The dynamic balancing operation is usually performed by carving a small amount out of the upper and lower surfaces of the rotor 42 with a drill or the like. When the dynamical balance of the rotating body is well achieved, the high-speed rotating body can rotate at high speed and thus the pump can operate quietly with little vibration. However, during high-speed rotation, a centrifugal force causes stress concentrations to occur around fine drilled bores formed for dynamic balance on the upper and lower surfaces of the rotor 42, and also, when a process gas causes the upper and lower surfaces to corrode around some of the drilled bores, cracks occur around the corroded portions of these surfaces. Thus, both problems may cause a brittle fracture of the high-speed rotating body.

This problem is not limited to the drilled bores formed for dynamic balance. When some kind of defect exists even in other parts of the high-speed rotating body, a stress concentration occurs at the defect, thereby causing a brittle fracture of the high-speed rotating body.

Since the breakage of the rotor 42 starting at one of the stress concentration points thereof occurs when the rotor 42 and the rotor blades 41 are rotating at high speed, its breaking energy is so large that the breaking energy quickly has an impact on and accordingly breaks the entire rotor 42 and rotor blades 41, and thus broken pieces of these components are caused to fly out due to a centrifugal force and forcefully stop rotation of the drive motor 47 to rotate. A reaction of the forceful stop causes the motor casing (stator column) 45 to receive a large torque (hereinafter, referred to as a damaging torque) and thus pump-chamber fastening bolts 6 for fastening the pump to the vacuum chamber 3 to be broken. As a result, the fall of the pump may lead to break a part of the semiconductor production equipment or to a serious accident causing injury or death.

Vacuum pumps having a large capacity have been increasingly used in recent years. As the vacuum pump becomes larger, the damaging torque due to a centrifugal force becomes larger, thereby resulting in a larger risk of a falling accident of the pump.

In order to prevent the fall of the pump by limiting the above-mentioned breakage so as to be small within the pump, various improvements for preventing the pump-chamber fastening bolts from being broken even when the damaging torque occurs have been heretofore attempted.

Unfortunately, these improvements have not assured that the pump-chamber fastening bolts have no risk of being broken at all.

SUMMARY OF THE INVENTION

The present invention has been made in order to solve the above-mentioned problems. Accordingly, it is an object of the present invention to provide a turbo-molecular pump which does not fall even when pump-chamber fastening bolts are broken in case of a breaking accident of a rotor rotating at a high-speed.

In order to achieve the above object, a turbo-molecular pump according to the present invention comprises a pump case for covering the main body of the pump; a flange integrally formed with the pump case and disposed close to a vacuum chamber; a plurality of pump-chamber fastening bolts for fastening the flange to a vacuum chamber flange of the vacuum chamber; and at least one auxiliary flange-fixing attachment for fixing or sandwiching the flange and the vacuum chamber flange from the outer peripheries thereof.

In the turbo-molecular pump, each of the auxiliary flange-fixing attachments comprises an upper retainer for pressing the vacuum chamber flange from above; a lower retainer for pressing the pump flange from below; and a plurality of fastening screws for fastening the upper and lower retainers, and the upper and lower retainers cramp the two flanges from the outer peripheries thereof.

The upper and lower retainers have arch shapes lying along the respective flanges.

The auxiliary flange-fixing attachments are fastened together with the pump flange and the vacuum chamber flange by the pump-chamber fastening bolts.

The auxiliary flange-fixing attachments comprise a plurality of split rings, which form one ring; and a plurality of split-ring connecting means for connecting the split rings so as to form a ring shape, and the plurality of split rings cramp the two flanges from the outer peripheries thereof.

The auxiliary flange-fixing attachment comprises a plurality of upper plates covering the vacuum chamber flange from above; a plurality of lower plates covering the pump flange from below; and a plurality of plate connectors for connecting the pluralities of upper and lower plates so as to sandwich the vacuum chamber flange and the pump flange therebetween.

In the auxiliary flange-fixing attachment comprising the upper and lower plates, the lower surfaces of the upper plates are placed on the upper surface of the vacuum chamber flange and the auxiliary flange-fixing attachment is suspended from and supported by the vacuum chamber flange.

In addition, the plate connector comprises at least one abutting piece which abuts against the side surface of the vacuum chamber flange so as to fix the auxiliary flange-fixing attachment to the vacuum chamber flange, and the abutting piece is a screw, which is screwed in the plate connector until its to abuts against the side surface of the vacuum chamber flange.

Moreover, the upper surfaces of the lower plates and the lower surface of the pump flange or the upper surfaces of the lower plates and the head end surfaces of the pump-chamber fastening bolts have a gap therebetween, and the gap is set equal to or greater than one thread pitch of the pump-chamber fastening bolt.

DETAILED DESCRIPTION OF THE PREFERRED EMBODIMENTS

Turbo-molecular pumps according to preferred embodiments of the present invention will be described with reference to the accompanying drawings.

Figure 1A:
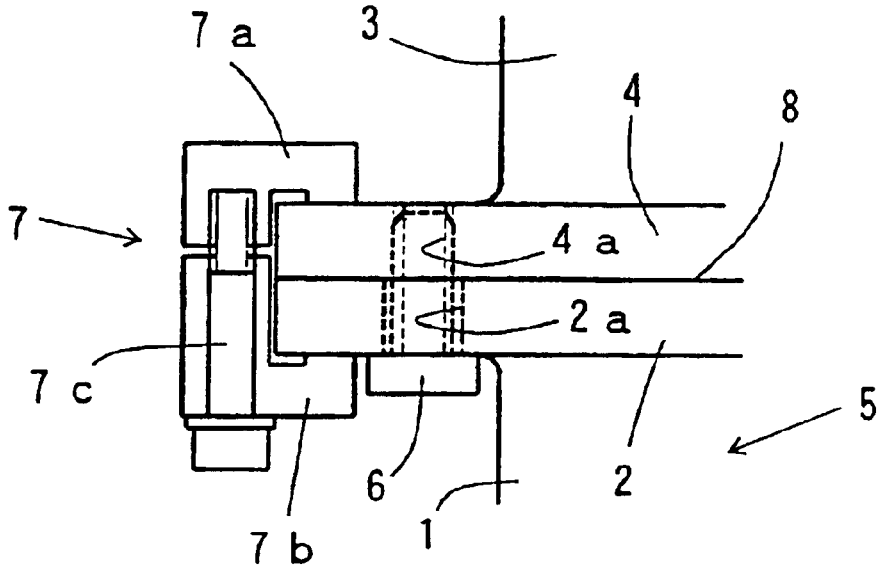
FIG. 1A is a partial elevational view of a major part of an embodiment of a turbo-molecular pump according to the present invention, wherein an auxiliary flange-fixing attachment for fastening flanges is shown in a sectional view.
Figure 1B:
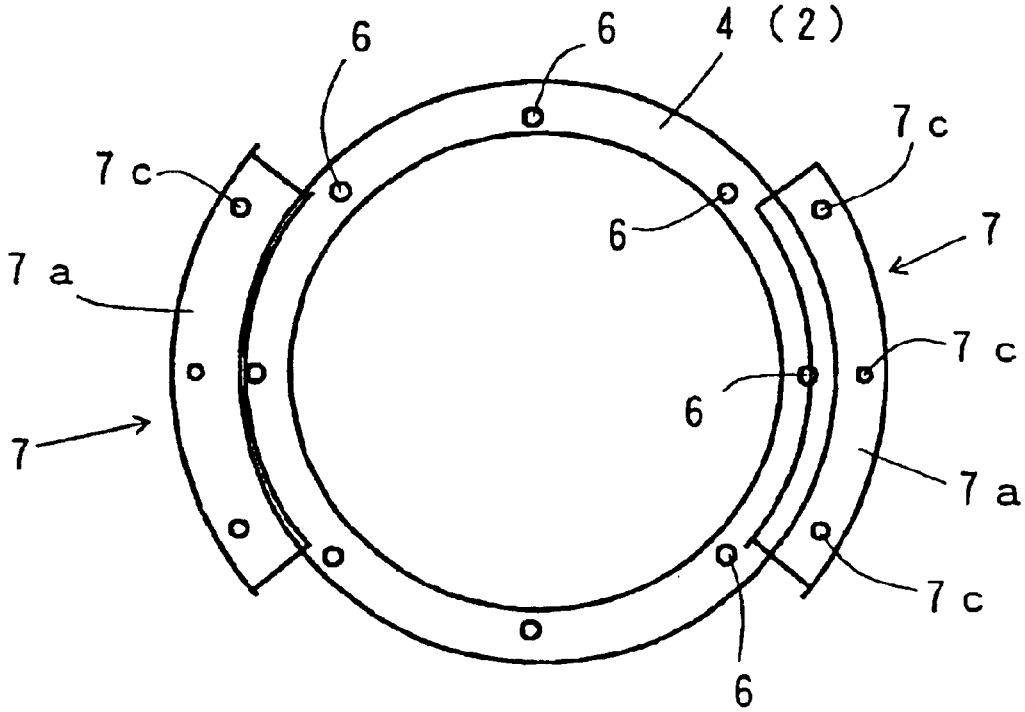
FIG. 1B is a plan view of the major part.

FIG. 1A is a partial elevational view of a major part of a first embodiment of a turbo-molecular pump according to the present invention, wherein an auxiliary flange-fixing attachment for fastening flanges is shown in a sectional view, and FIG. 1B is a plan view of the major part.

Figure 12:
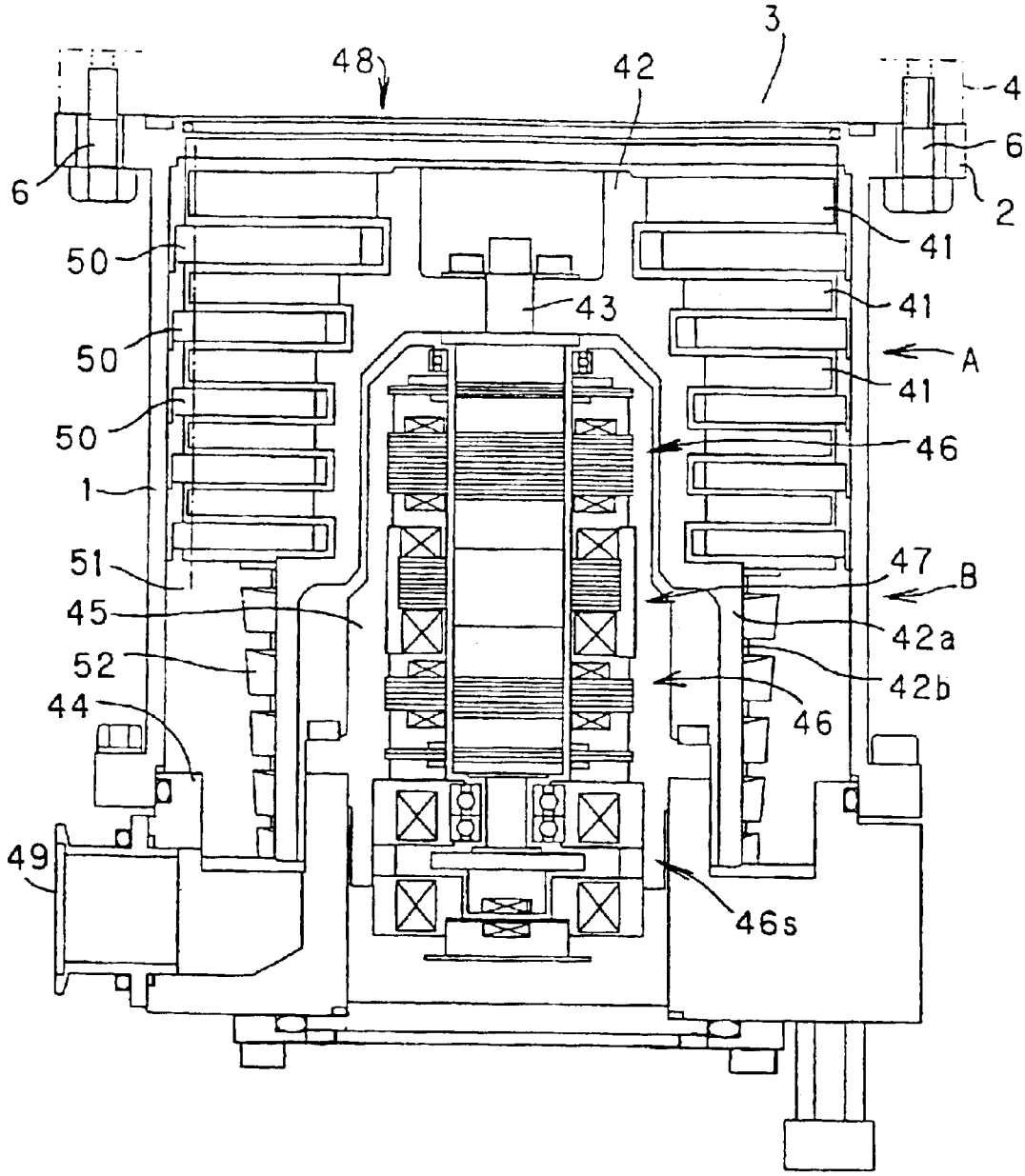
FIG. 12 is a longitudinal sectional view of an example known turbo-molecular pump.

As shown in FIGS. 1A and 1B, a turbo-molecular pump 5 has a pump case 1 housing its main body (i.e., two pump mechanism portions A and B shown in FIG. 12) therein, and a flange 2 integrally formed with the pump case 1 and disposed close to a vacuum chamber 3 which lies above the pump and has a vacuum chamber flange 4 so as to face the flange 2.

As is well known, the turbo-molecular pump 5 is connected and fixed to the vacuum chamber 3 by arranging the flange 2 and the vacuum chamber flange 4 so as to abut against each other; and by connecting the flanges 2 and 4 together with connecting means such as a plurality of pump-chamber fastening bolts 6 which are passed through pluralities of bolt holes 2*a* and threaded holes 4*a* evenly spaced in the flanges 2 and 4, respectively, and then fastened. The flanges 2 and 4 have a sealing gasket (not shown) inserted therebetween so as to hermetically seal them.

The above described structure is the same as that of the conventional turbo-molecular pump.

The turbo-molecular pump 5 shown in FIGS. 1A and 1B according to this embodiment of the present invention has two arch-shaped support-stays (auxiliary flange-fixing attachments) 7 constituting clamping means for clamping or fixing the flange 2 and the vacuum chamber flange 4 by clamping or cramping them at two outer peripheral points thereof.

The support-stays 7 will be described in detail below.

Each of the support-stays 7 has an upper retainer 7*a* for pressing the vacuum chamber flange 4 downwards, a lower retainer 7*b* for pressing the flange 2 of the turbo-molecular pump 5 upwards, and a plurality of fastening screws 7*c* for fastening the upper and lower retainers 7*a* and 7*b* together. With this structure, the flanges 2 and 4 are cramped and held by the upper and lower retainers 7*a* and 7*b* from the outer peripheries thereof so as to improve their fastening strength. Thus each of the upper and lower retainers 7*a*, 7*b* is a clamping member which, when connected together by fastening screws 7*c*, clamp the flanges 2 and 4 together as described above.

Figure 2:
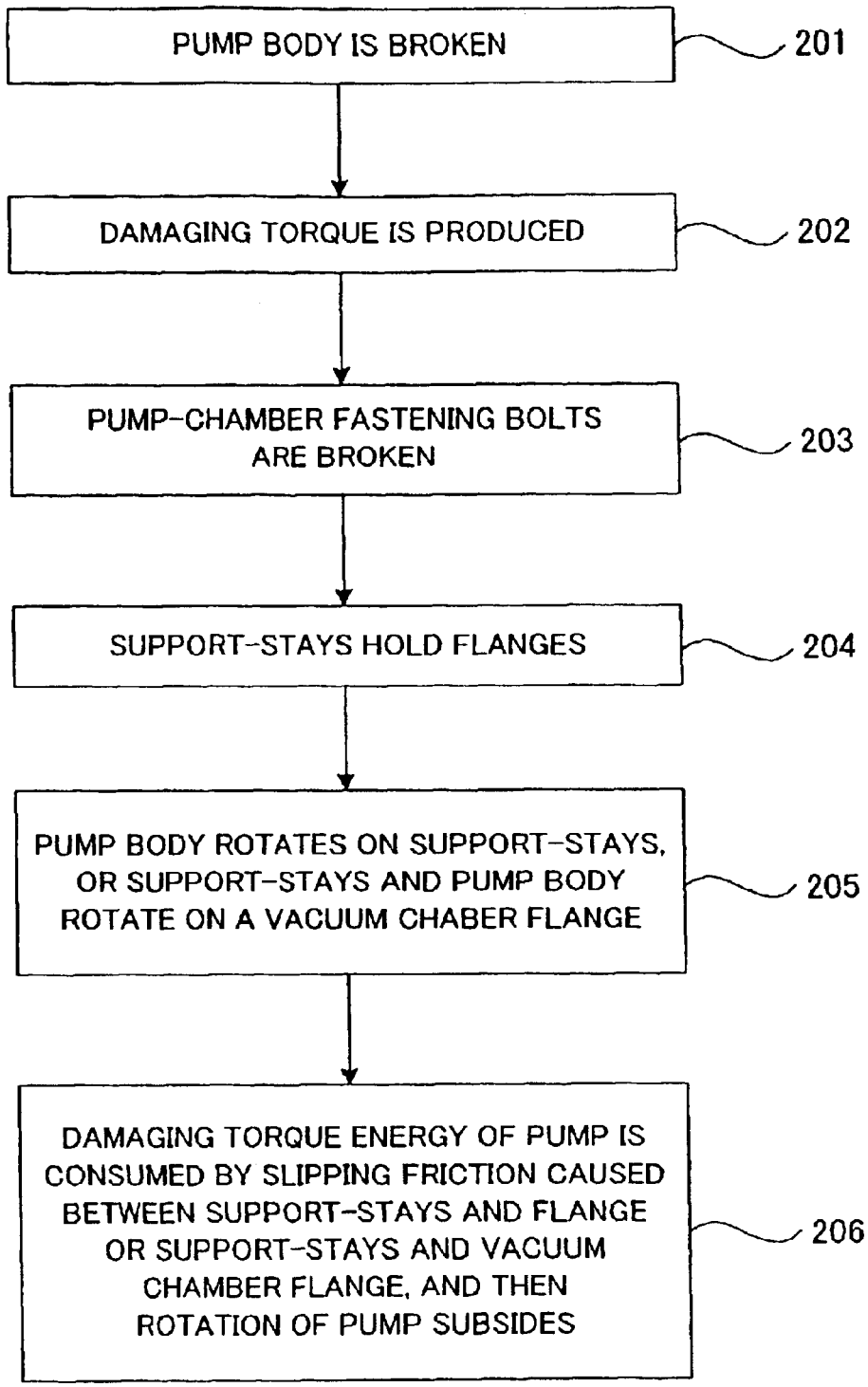
FIG. 2 is a flowchart illustrating an energy absorption process of a damaging torque according to the present invention.

In case of a breaking accident of the rotor 42 in the main body of the pump (hereinafter, referred to as pump body) due to a brittle fracture or the like, the pump body may be broken. An energy absorption process of a damaging torque produced when the pump body is broken will be described with reference to FIG. 2.

When the pump body is broken (Step 201), the damaging torque is produced (Step 202) and exerted on the flanges 2 and 4. When the exerted damaging torque overcomes a torque due to a frictional force on a flange-abutting surface 8 between the flanges 2 and 4 produced by fastening the pump-chamber fastening bolts 6 and the fastening screws 7*c*, the flanges 2 and 4 slip against each other on the flange-abutting surface 8 and partially absorb the energy of the damaging torque. Then, when no gap is left between the bolt holes 2*a* and the shafts of the corresponding pump-chamber fastening bolts 6, the remaining damaging torque causes the pump-chamber fastening bolts 6 to be bent or sheared so that the energy of the remaining torque is partially absorbed.

When the damaging torque subsides by the absorbed energy of the damaging torque so far, there is no risk of a falling accident of the turbo-molecular pump. In this embodiment, since the two flanges are additionally fastened by the fastening screws 7*c*, the frictional force between the two flanges becomes larger. With this arrangement, since the energy of the damaging torque absorbed by the slipped flanges is larger than that in the known turbo-molecular pump, the damaging torque is most likely to subside at this stage.

When the energy of the damaging torque still remains and breaks all the pump-chamber fastening bolts 6 (Step 203), the known turbo-molecular pump would have a risk of a falling accident. However, according to the present invention, since the damaging torque is not exerted on the auxiliary flange-fixing attachments (support-stays) 7 and these attachments 7 hold the flanges 2 and 4, the turbo-molecular pump 5 does not fall (Step 204).

When the energy of the damaging torque still remains in the pump body and causes the pump body to keep rotating further, the flange 2 slips and rotates against the upper surface of the lower retainer 7*b* of the auxiliary flange-fixing attachments 7 or the pump body and the auxiliary flange-fixing attachments 7 rotate together and slip against the upper surface of the vacuum chamber flange 4 (Step 205). As a result, this slipping friction causes the remaining energy of the damaging torque to be consumed and the rotation of the pump to subside (Step 206).

The number of the support-stays (auxiliary flange-fixing attachments) 7 is not limited to two; but three or more attachments may be almost evenly spaced around the flanges 2 and 4.

Although the upper and lower retainers 7*a* and 7*b* have arch shapes lying along the flanges 2 and 4 so as to reliably circumscribe the flanges 2 and 4, respectively, when a large number of the auxiliary flange-fixing attachments 7 are used, the attachments are not always required to have arch shapes.

Figure 3A:
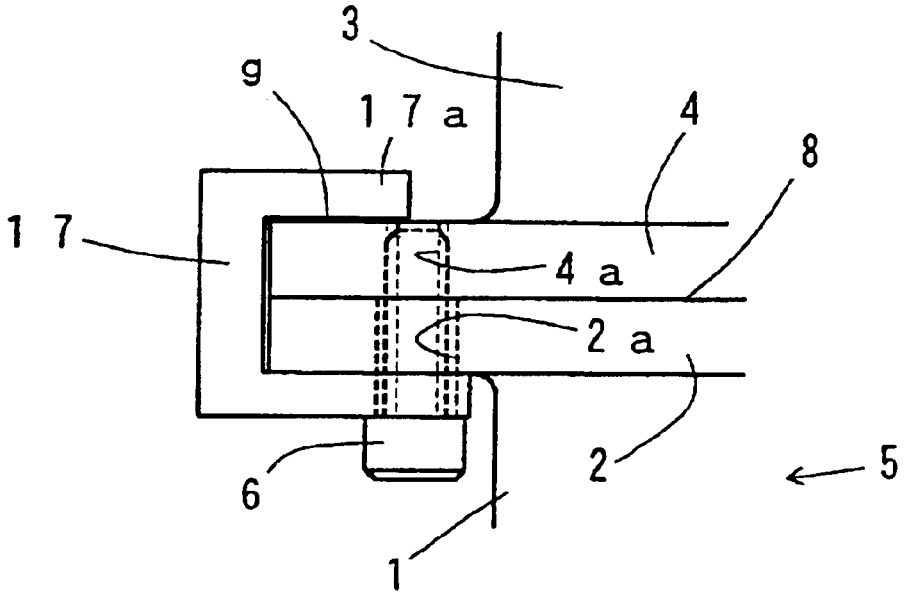
FIGS. 3A and 3B are a partial elevational view and a plan view of another embodiment of a major part of a turbo-molecular pump according to the present invention.
Figure 3B:
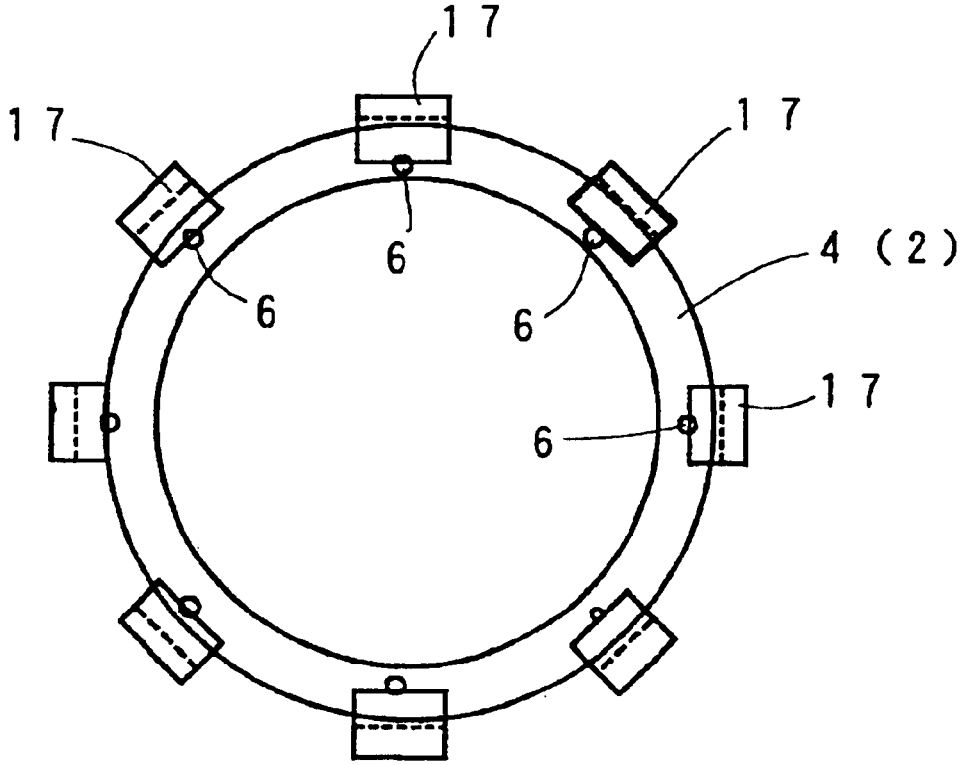

FIGS. 3A and 3B are a partial elevational view and a plan view of a major part of a second embodiment of a turbo-molecular pump according to the present invention. Like parts shown in FIGS. 3A and 3B are identified by the same reference numerals as shown in FIGS. 1A and 1B, and the description thereof is omitted.

In the turbo-molecular pump according to the second embodiment, a plurality of auxiliary flange-fixing attachments 17 having a hooked shape so as to sandwich the flange 2 and the vacuum chamber flange 4 are circularly disposed at the places corresponding to the pump-chamber fastening bolts 6, and the auxiliary flange-fixing attachments 17 are fastened together with the flange 2 and the vacuum chamber flange 4 by the pump-chamber fastening bolts 6. With this arrangement, although a slight amount of gap g is produced between the upper surface of the vacuum chamber flange 4 and the lower surface of an upper hooked portion 17i a l of each auxiliary flange-fixing attachment 17, since the auxiliary flange-fixing attachments 17 sandwich the flanges 2 and 4, even when the pump-chamber fastening bolts 6 are broken, the auxiliary flange-fixing attachments 17 support the turbo-molecular pump 5 and accordingly prevent it from falling.

In this embodiment, since the auxiliary flange-fixing attachments 17 are fastened together with the flanges 2 and 4, even when the auxiliary flange-fixing attachments 17 partially sandwich the peripheral edges of the flanges 2 and 4 from the outer peripheries thereof, the auxiliary flange-fixing attachments 17 do not fall, not only during a normal operation but also when the pump-chamber fastening bolts 6 are broken.

By utilizing the hooked shape of the auxiliary flange-fixing attachments 17, the flanges 2 and 4 can be more strongly fastened. In order to achieve this purpose, for example, as shown in FIG. 4, setscrews 40 are screwed into the upper hooked portions 17*a* of the corresponding auxiliary flange-fixing attachments 17 so as to push the upper surface of the vacuum chamber flange 4 at the heads of the setscrews.

Figure 4:
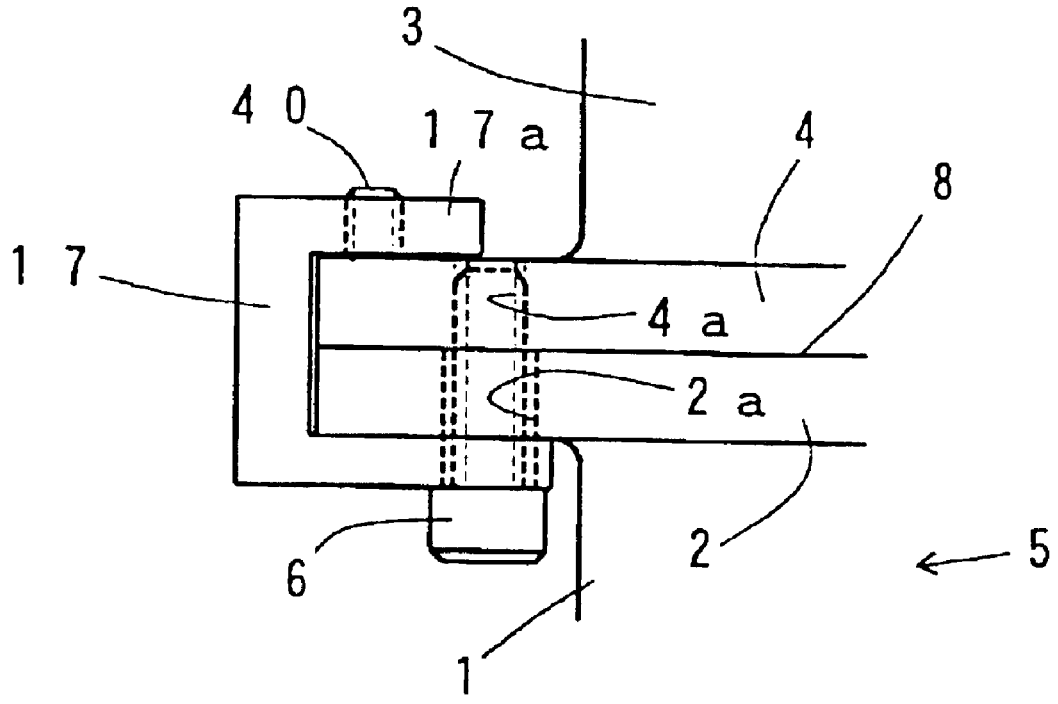
FIG. 4 is a partial elevational view of another embodiment of a major part of a turbo-molecular pump according to the-present invention.

In the turbo-molecular pump according to the embodiment shown in FIGS. 3A and 3B or FIG. 4, although one auxiliary flange-fixing attachment 17 is fastened together with the flanges 2 and 4 by one pump-chamber fastening bolt 6, the auxiliary flange-fixing attachment 17 may be fastened together with the flanges 2 and 4 by a plurality of the pump-chamber fastening bolts 6 by extending the auxiliary flange-fixing attachment 7 so as to overlap two or more of the pump-chamber fastening bolts 6.

Figure 5A:
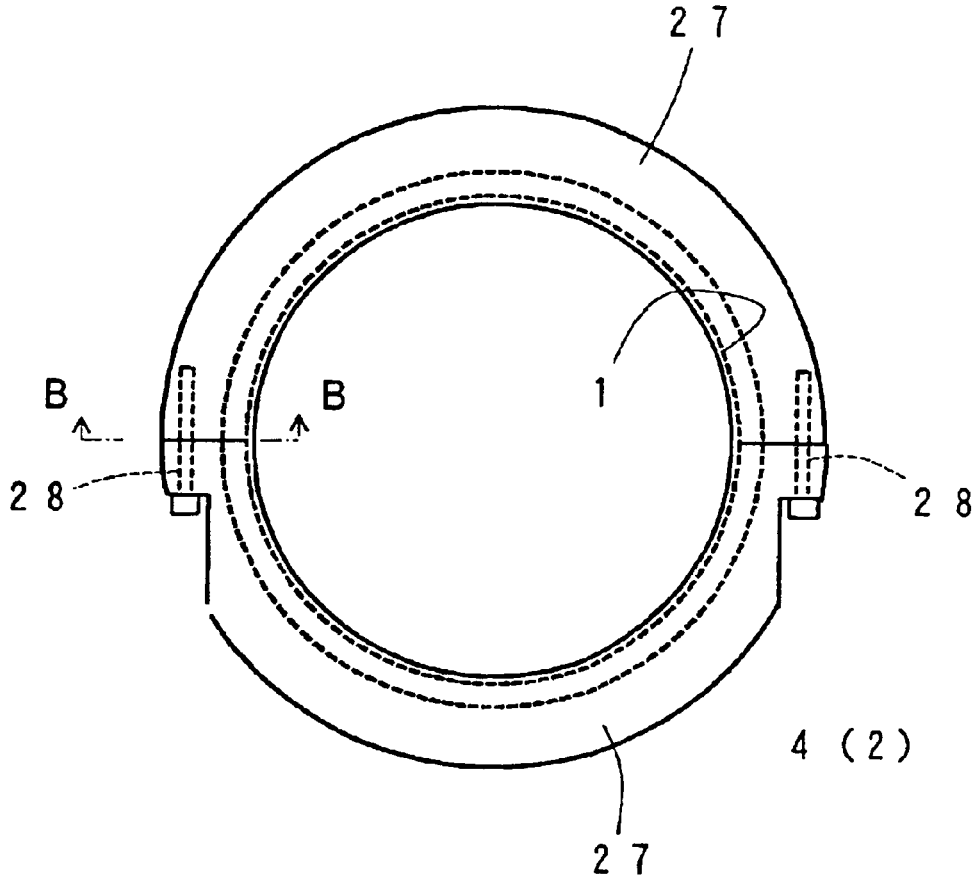
FIG. 5A is a plan view of an auxiliary flange-fixing attachment of another embodiment of a turbo-molecular pump according to the present invention.
Figure 5B:
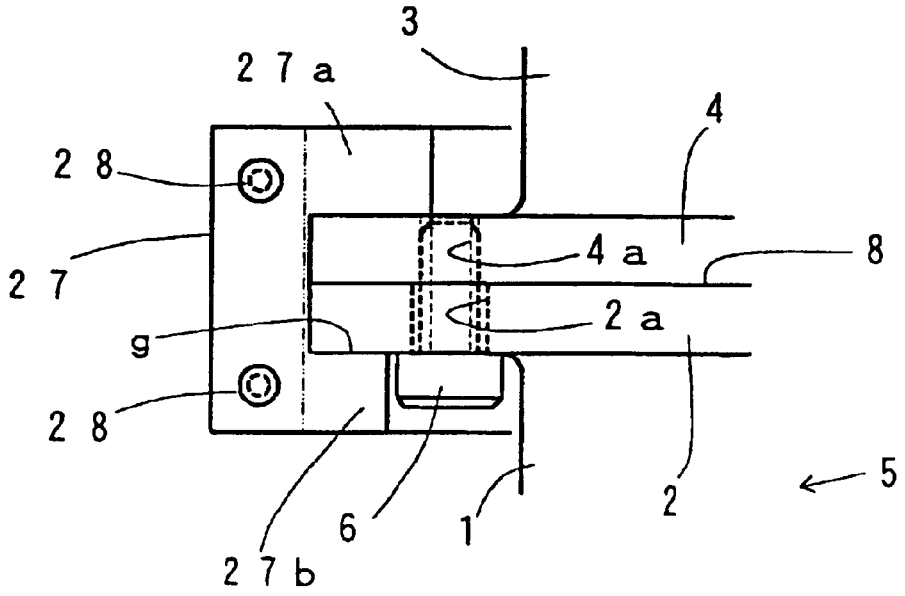
FIG. 5B is a sectional view taken along the line B—B indicated in FIG. 5A, wherein the pump is fixed to a vacuum chamber.

FIG. 5A is a plan view of an auxiliary flange-fixing attachment of a third embodiment of a turbo-molecular pump according to the present invention, and FIG. 5B is a sectional view taken along the line B—B indicated in FIG. 5A, wherein the pump is fixed to the vacuum chamber. Like parts shown in FIGS. 5A and 5B are identified by the same reference numerals as shown in FIGS. 1A and 1B, and the description thereof is omitted.

In the turbo-molecular pump according to the embodiment shown in FIGS. 5A and 5B, split rings 27, each having a hooked-shape cross-section, sandwich the flanges 2 and 4 so as to surround the outer peripheries thereof and are fastened by bolts 28 so as to form a ring shape.

That is, the auxiliary flange-fixing attachments according to this embodiment are formed by the plurality of split rings 27, which form one ring and by the bolts (connecting means) 28 for connecting these split rings so as to form a ring shape.

The number of the split rings 27 is not limited to two; but it may be three or more. Also, the connecting means for these split rings are not limited to bolts or screws; but the split rings may be fastened by a band from the outside thereof.

Figure 6:
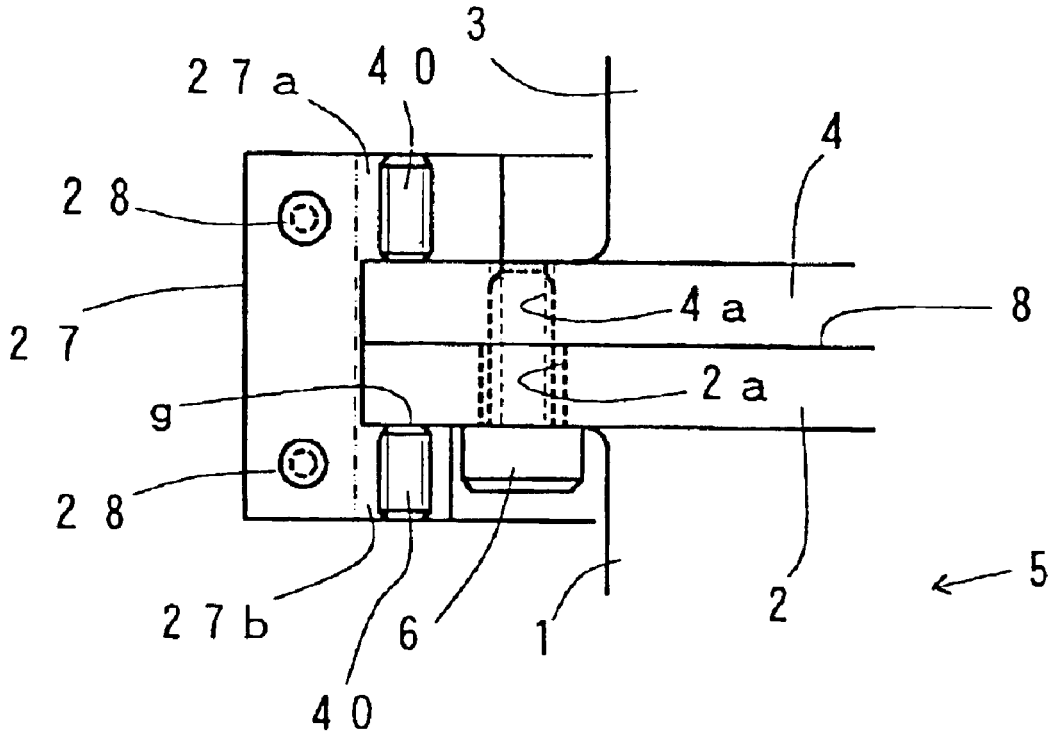
FIG. 6 is a partial elevational view of another embodiment of a major part of a turbo-molecular pump according to the present invention.

Also, in the turbo-molecular pump according to the embodiment shown in FIGS. 5A and 5B, by fixing the split rings 27 to the flanges 2 and 4 so as to fasten the two flanges more strongly, the flange-abutting surface 8 may have an increased frictional force thereon. In order to achieve this purpose, for example, the setscrews 40 are screwed in either an upper hooked portion 27*a* or a lower hooked portion 27*b* of each split ring 27 or in both the upper and lower hooked portions 27*a* and 27*b*, as shown in FIG. 6, so as to fasten the flanges 2 and 4.

Figure 7A:
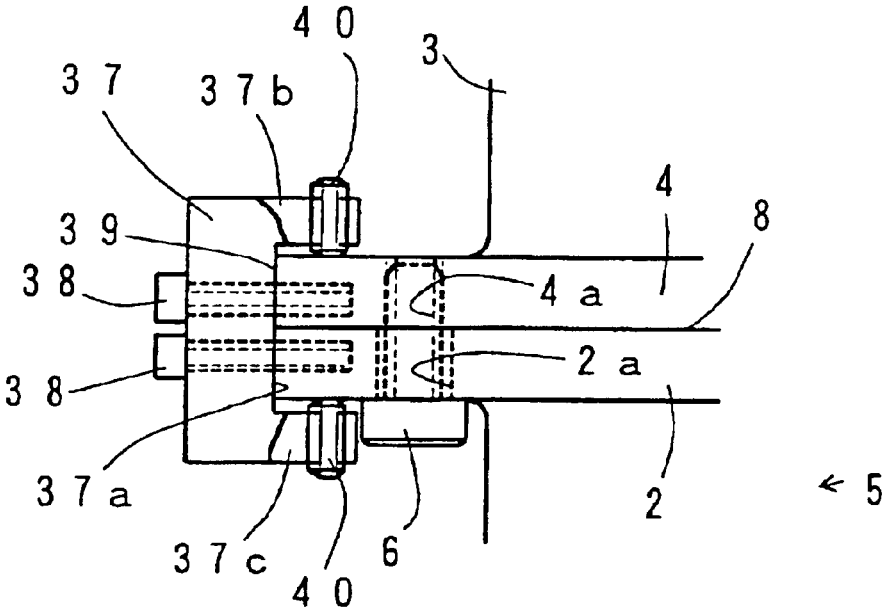
FIGS. 7A and 7B are a partial elevational view and a plan view of another embodiment of a major part of a turbo-molecular pump according to the present invention.
Figure 7B:
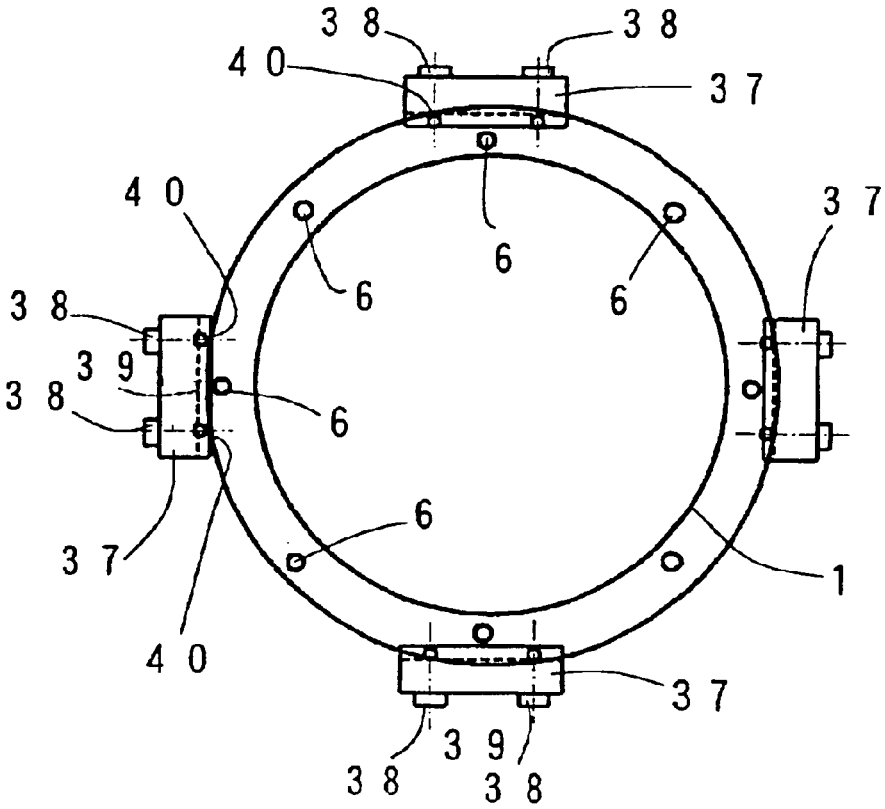

FIGS. 7A and 7B are a partial elevational view and a plan view of a major part of another embodiment of a turbo-molecular pump according to the present invention. Like parts shown in FIGS. 7A and 7B are identified by the same reference numerals as shown in FIGS. 1A and 1B, and the description thereof is omitted.

In the turbo-molecular pump according to the embodiment shown in FIGS. 7A and 7B, the flange 2 of the turbo-molecular pump and the vacuum chamber flange 4 have common flat portions 39 for fixing support-stays (auxiliary flange-fixing attachments) 37, formed at four places of the outer peripheral surfaces thereof, and the support-stays 37 are fixed to these flat portions 39. More particularly, in a state in which a flat bottom surface 37*a* of each support-stays 37 abuts against the corresponding common flat portion 39 of the flange 2 of the turbo-molecular pump and the vacuum chamber flange 4, the flange 2 and the vacuum chamber flange 4 are fixedly fastened with each other from the outer peripheries thereof by screwing screws 38 in the flanges 2 and 4 and are also pressed downwards and upwards by screwing the setscrews 40 in hooked portions 37*b* and 37*c* of the support-stays 37, respectively, so as to be fastened with each other more strongly.

In this embodiment, although the screws 38 of the support-stays 37 may undergo a damaging torque together with the pump-chamber fastening bolts 6, since the overall flanges 2 and 4 are more strongly fastened by the screws 38, the pump-chamber fastening bolts 6 are very unlikely to be broken. In addition, even in case that the screws 38 are broken, the hooked portions 37*b* and 37*c* prevent the pump from falling.

Figure 8:
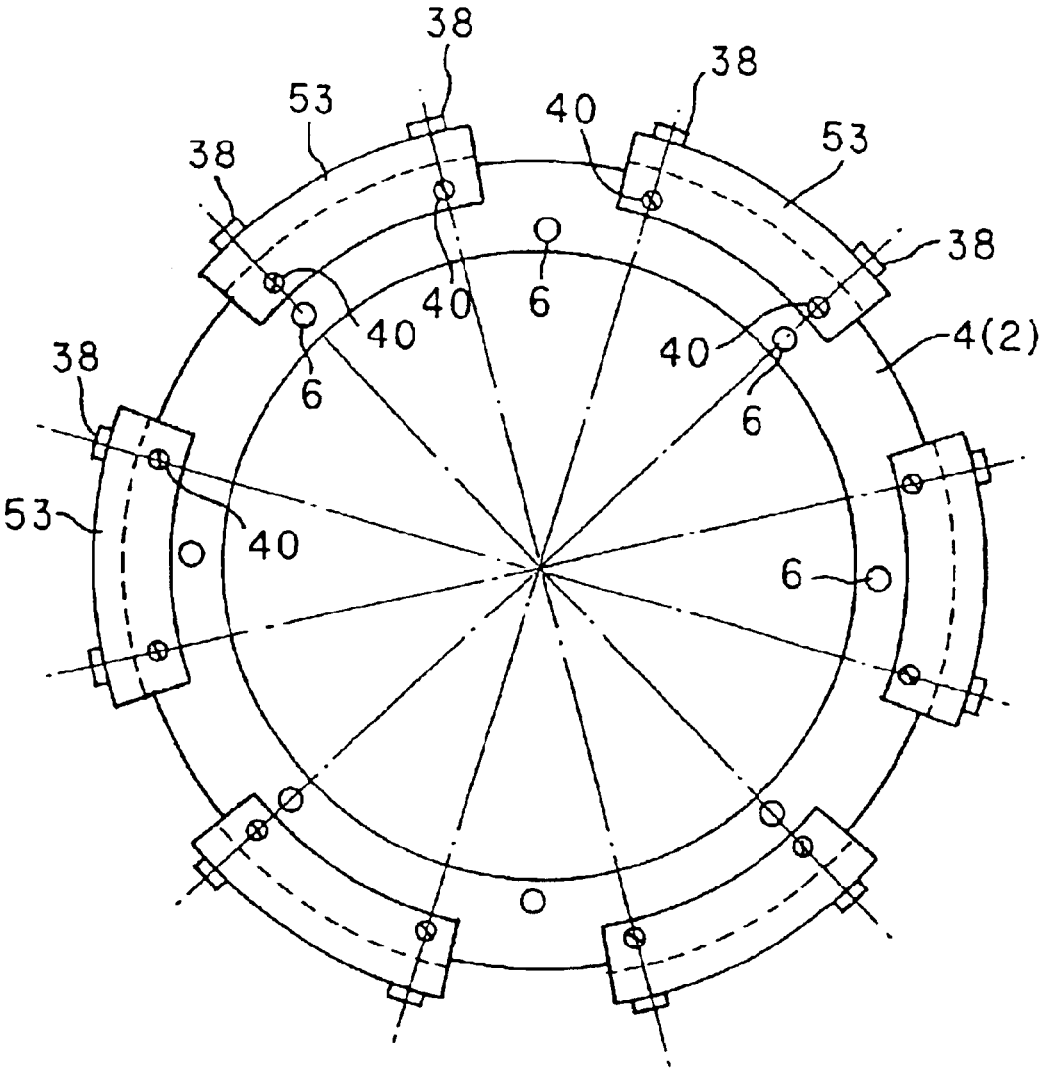
FIG. 8 is a plan view of another embodiment of a major part of a turbo-molecular pump according to the present invention.

FIG. 8 is a plan view of a major part of another embodiment of a turbo-molecular pump according to the present invention. Like parts shown in FIGS. 8A and 8B are identified by the same reference numerals as shown in FIGS. 7A and 7B, and the description thereof is omitted.

The turbo-molecular pump according to the embodiment shown in FIG. 8 differs from the pump according to the embodiment shown in FIGS. 7A and 7B in that arch-shaped support-stays (auxiliary flange-fixing attachments) are used without forming the flat portions on the outer peripheral surfaces of the flange 2 of the turbo-molecular pump and the vacuum chamber flange 4. The arch-shaped support-stays surround more parts of the flanges 2 and 4 and thus more reliably support them.

As shown in FIG. 8, the flanges 2 and 4 are sandwiched by the upper and lower hooked portions of arch-shaped support-stays (auxiliary flange-fixing attachments) 53, each having a horseshoe-shaped cross-section lying in the direction of the radii of the two flanges in the same fashion as that shown in FIG. 7A, and are fixedly fastened by the setscrews 40 from above and below. The screws 38 for fastening the flanges 2 and 4 and the support-stays 53 are radially disposed in the direction of the radii of the two flanges.

Figure 9A:
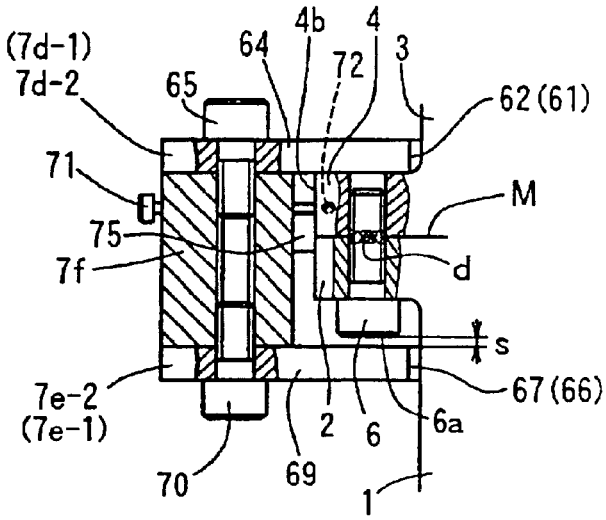
FIG. 9A is a sectional view of another embodiment of a major part of a turbo-molecular pump according to the present invention, taken along the line 9A—9A indicated in FIG. 9B.
Figure 9B:
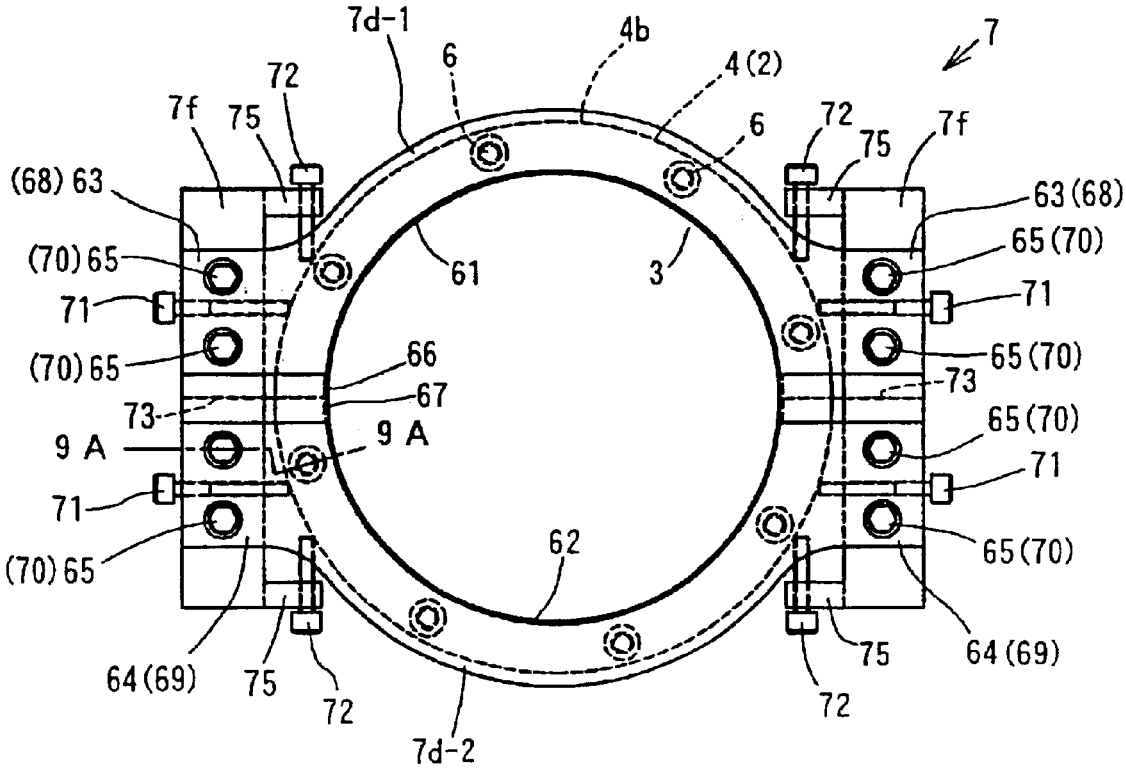
FIG. 9B is a plan view of the major part.

FIG. 9A is a sectional view of a major part of a further embodiment of a turbo-molecular pump according to the present invention, taken along the line 9A—9A indicated in FIG. 9B, and FIG. 9B is a plan view of the major part. Like parts shown in FIGS. 9A and 9B are identified by the same reference numerals as shown in FIGS. 1A and 1B, and the description thereof is omitted.

The turbo-molecular pump according to the embodiment shown in FIGS. 9A and 9B differs from the pumps according to the above-described embodiments in that an auxiliary flange-fixing attachment has pluralities of upper and lower plates covering the vacuum chamber flange from above and the pump flange from below, respectively, and plate connectors for sandwiching the vacuum chamber flange and the pump flange between the upper and lower plates by connecting the pluralities of upper and lower plates.

With this structure, the auxiliary flange-fixing attachment 7 is easily fixed even after the turbo-molecular pump is fixed to the vacuum chamber, and also, even when the pump body is broken, the auxiliary flange-fixing attachment 7 firmly supports the flanges 2 and 4 and thus reliably prevents the pump from falling. In addition, the energy of the damaging torque of the pump is absorbed by the friction between the auxiliary flange-fixing attachment 7 and the pump flange 2 or between the vacuum chamber flange 4 and the auxiliary flange-fixing attachment 7 so that the rotation of the pump subsides quickly.

As shown in FIGS. 9A and 9B, the auxiliary flange-fixing attachment 7 has a pair of upper plates 7*d*-1 and 7*d*-2, a pair of lower plates 7*e*-1 and 7*e*-2, and a pair of plate connectors 7*f*.

Since the upper plates 7*d*-1 and 7*d*-2 have arch-shaped surfaces 61 and 62, respectively, the arch-shaped surfaces 61 and 62 are arranged so as to face each other, and the upper plates 7*d*-1 and 7*d*-2 are fixed by bolts 65 to the plate connectors 7*f*, respectively, at lugs 63 and 64 formed at both sides thereof so as to cover the vacuum chamber flange 4 from above.

Since the lower plates 7*e*-1 and 7*e*-2 have arch-shaped surfaces 66 and 67, respectively, the arch-shaped surfaces 66 and 67 are arranged so as to face each other, the lower plates 7*e*-1 and 7*e*-2 are fixed by bolts 70 to the plate connectors 7*f*, respectively, at lugs 68 and 69 formed at both sides thereof so as to cover the pump flange 2 from below.

As described above, the pluralities of upper plates 7*d*-1 and 7*d*-2 and lower plates 7*e*-1 and 7*e*-2 are connected by the plate connectors 7*f* so that the vacuum chamber flange 4 and the pump flange 2 are sandwiched between the upper and lower plates.

In this state, the lower surfaces of the upper plates 7*d*-1 and 7*d*-2 are placed on the upper surface of the vacuum chamber flange 4, and thus the auxiliary flange-fixing attachment 7 is suspended from and supported by the vacuum chamber flange 4.

Each of the plate connectors 7*f* has pluralities of screws (abutting pieces) 71 and 72. The abutting pieces 71 are disposed in the main body of the plate connector 7*f* so as to be parallel to an opposing surface 73 of the lower plates. The abutting pieces 72 are disposed at respective projecting pieces 75 projecting from the main body of the plate connector 7*f* towards the two flanges so as to be orthogonal to the opposing surface 73. By arranging these screws (abutting pieces) 71 and 72 so as to abut against a side surface 4*b* of the vacuum chamber flange 4, the auxiliary flange-fixing attachment 7 is fixed to the vacuum chamber flange 4. As a result, since the auxiliary flange-fixing attachment 7, which was just suspended from the vacuum chamber flange 4 is now united therewith, it is prevented from vibration during an operation of the pump.

The abutting pieces are not limited to screws; but they may have another structure such as a spring as long as they abut against the vacuum chamber flange 4 and prevent the auxiliary flange-fixing attachment 7 from vibration. Also, the abutting pieces are not limited to the structure in which they abut against the cylindrical side surface of the vacuum chamber flange 4; but they may have another structure in which they abut against lugs which project from the cylindrical side surface, or notches which are cut thereon, so as to serve as abutting surfaces. With this structure, the auxiliary flange-fixing attachment is more reliably fixed.

The upper surface of the lower plates 7*e*-1 and 7*e*-2 and head end surfaces 6*a* of the pump-chamber fastening bolts 6 are spaced apart at a distance with a gap s therebetween. The gap s is set so as to be equal to or greater than one thread pitch of the pump-chamber fastening bolt 6. The reason of this setting of the gap s is described with reference to FIG. 11.

Figure 11:
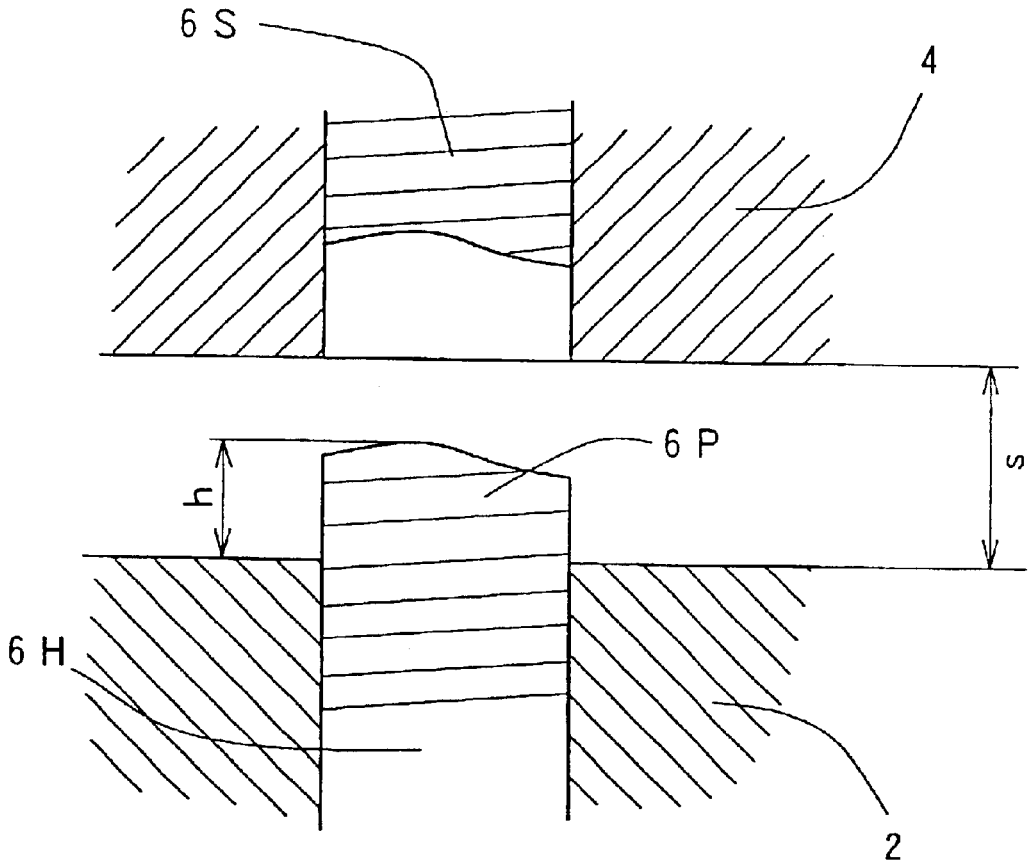
FIG. 11 is a sectional view illustrating the broken state of one of the fastening bolts shown in FIGS. 9 and 10.

When the pump-chamber fastening bolts 6 are broken due to the damaging torque, broken head parts 6H of the fastening bolts 6 fall onto the upper surfaces of the lower plates 7*e*-1 and 7*e*-2, causing the pump body to fall and the flange 2 of the pump to be supported by the lower plates 7*e*-1 and 7*e*-2. When the gap between the upper surfaces of the lower plates 7*e*-1 and 7*e*-2 and the head end surfaces 6*a* of the pump-chamber fastening bolts 6 were set equal to s, the gap between the lower surface of the vacuum chamber flange 4 and the upper surface of the flange 2 becomes s in this state, as shown in FIG. 11.

The fastening bolts are usually broken by shearing due to the damaging torque. Since this shearing occurs in a region d (see FIG. 9) within one thread pitch of the fastening bolt above and below from an abutting surface M between the flanges 2 and 4, when some of the pump-chamber fastening bolts 6 are sheared in the vacuum chamber flange 4 due to the energy of the damaging torque, and the head part 6H and a screw part 6S of the threaded portion of each fastening bolt are divided apart from each other, a projection 6P of the threaded portion of the fastening bolt projects by the length of h from the upper surface of the pump flange 2. Contrary to the state shown in FIG. 11, when the others of the pump-chamber fastening bolts 6 are broken in the pump flange 2, the projection 6P of the threaded portion of the fastening blot projects by the length of h from the lower surface of the vacuum chamber flange 4.

When the gap between the upper surfaces of the lower plates 7*e*-1 and 7*e*-2 and the head end surfaces 6*a* of the pump-chamber fastening bolts 6 is set equal to or greater than one thread pitch of the fastening bolt, since the condition s−h>0 is satisfied, the projection 6P of the threaded portion of the fastening blot projecting from the surface of one of the flanges 2 and 4 (i.e., the lower surface of the vacuum chamber flange 4 or the upper surface of the pump flange 2) is kept away from the surface of the other flange and thus does not interfere therewith.

Accordingly, the energy of the damaging torque remaining in the pump body allows the head parts 6H of the fastening bolts to rotate, and, when the fastening bolts are sheared, only minor part of the energy of the damaging torque is transmitted to the vacuum chamber.

Since the lower plates 7*e*-1 and 7*e*-2 remain in a non-rotational state, when the pump rotates, the head end surfaces 6*a* of the fastening bolts slides on the upper surfaces of the lower plates 7*e*-1 and 7*e*-2, thereby causing the friction of this sliding to absorb the energy of the damaging torque. In this embodiment, since the pair of under plates 7*e*-1 and 7*e*-2 have the opposing surfaces 73 therebetween abutting against each other and surround the pump flange 2 without a space between these under plates and the pump flange, the head end surfaces 6*a* of the plurality of fastening bolts can smoothly slide on the upper surfaces of the under plates 7*e*-1 and 7*e*-2.

In this embodiment, the abutting pieces 71 and 72 abut against the cylindrical surface of the vacuum chamber flange 4, these abutting pieces may slip on this abutting surface and accordingly the entire auxiliary flange-fixing attachment 7 may rotate together with the pump. In this case, the upper plates 7*d*-1 and 7*d*-2 slide on the upper surface of the vacuum chamber flange 4 and cause the energy of the damaging torque to be absorbed.

Figure 10A:
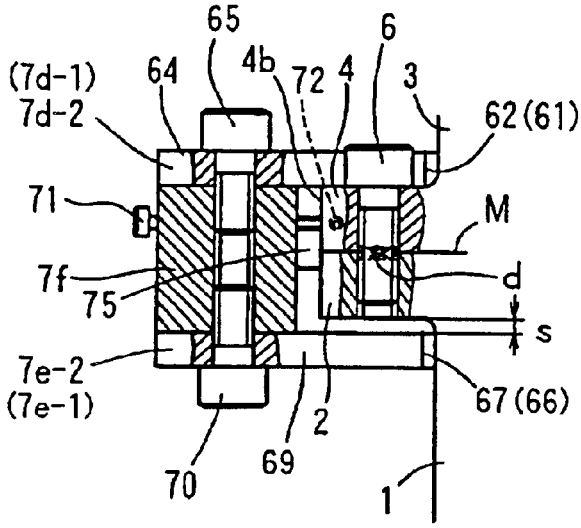
FIG. 10A is a sectional view of another embodiment of a major part of a turbo-molecular pump according to the present invention, taken along the line 10A—10A indicated in FIG. 10B.
Figure 10B:
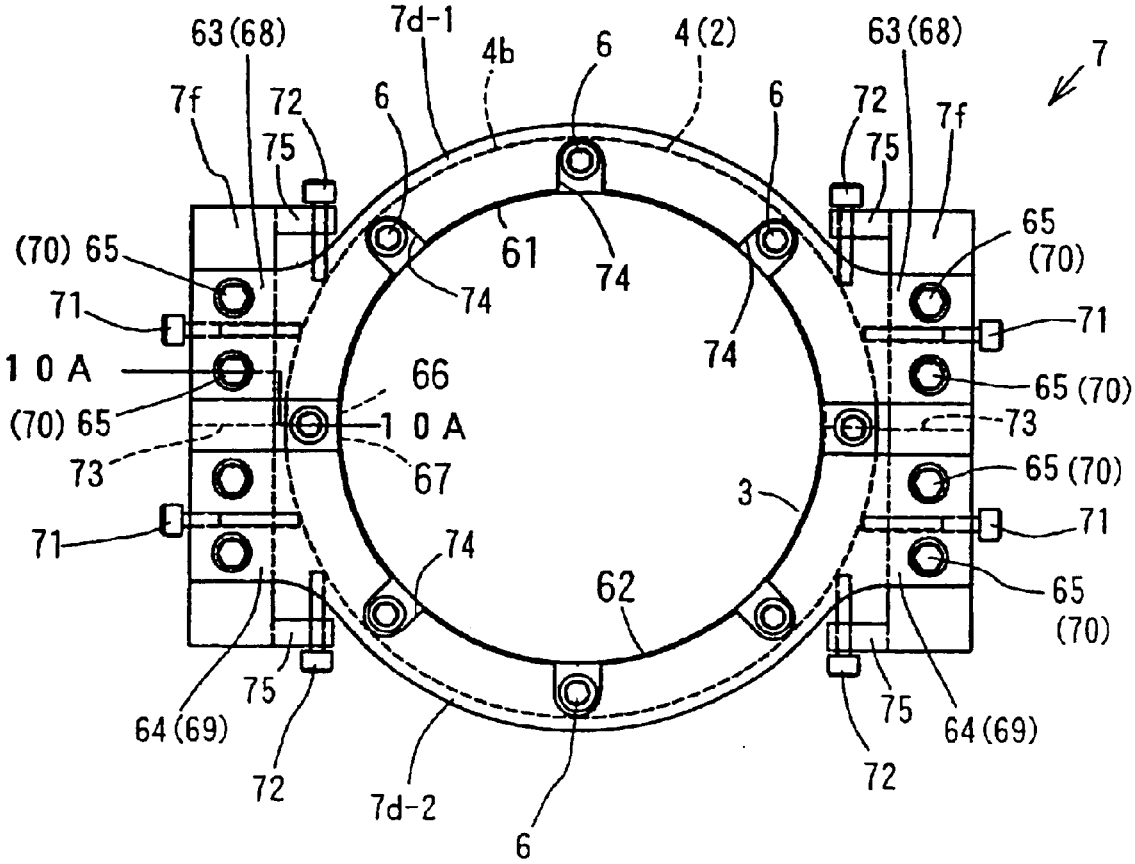
FIG. 10B is a plan view of the major part.

FIG. 10A is a sectional view of a further embodiment of a major part of a turbo-molecular pump according to the present invention, taken along the line 10A—10A indicated in FIG. 10B, and FIG. 10B is a plan view of the major part. Like parts shown in FIGS. 10A and 10B are identified by the same reference numerals as shown in FIGS. 9A and 9B, and the description thereof is omitted.

The turbo-molecular pump according to the embodiment shown in FIGS. 10A and 10B differs from the pump according to the embodiment shown in FIGS. 9A and 9B in that, contrary to the structure shown in FIGS. 9A and 9B, threaded holes of the pump-chamber fastening bolts 6 are drilled in the pump flange 2; bolt holes thereof are drilled in the vacuum chamber flange 4; and the pump-chamber fastening bolts 6 are screwed in the flanges 2 and 4 from above so as to fasten the pump and the chamber.

The upper plates 7*d*-1 and 7*d*-2 have a clearance 74 formed for each pump-chamber fastening bolt 6 and are directly placed on the upper surface of the vacuum chamber flange 4.

The upper surfaces of the lower plates 7*e*-1 and 7*e*-2 and the lower surface of the pump flange 2 have the gap s, therebetween, which is equal to or greater than 1.5 times one thread pitch of the pump-chamber fastening bolt 6. The other structure of the turbo-molecular pump according to the embodiment shown in FIGS. 10A and 10B is the same as that of the pump according to the embodiment shown in FIGS. 9A and 9B.

When the pump-chamber fastening bolts 6 are broken by the energy of the damaging torque, the lower surface of the pump flange 2 directly contacts the upper surfaces of the lower plates 7*e*-1 and 7*e*-2 and then slide thereon. The other operation of the turbo-molecular pump according to the embodiment shown in FIGS. 10A and 10B is the same as that of the pump according to the embodiment shown in FIGS. 9A and 9B.

In the embodiment shown in FIGS. 10A and 10B, since the heads of the fastening bolts 6 discretely disposed along a circle do not slide; instead, the continuous lower surface of the pump flange 2 slides on the lower plates 7*e*-1 and 7*e*-2, it is not always required to arrange the lower plates 7*e*-1 and 7*e*-2 to abut against each other without a space therebetween. Therefore, these lower plates may be disposed so as to face each other with a space in a similar fashion to that of the upper plates 7*d*-1 and 7*d*-2 shown in FIG. 10B.

In the embodiments shown in FIGS. 9A to 10B, the gap s between the head end surfaces 6*a* of the fastening bolts 6 and the lower plates or between the pump flange 2 and the lower plates can be easily adjusted by only adjusting the thickness of the plate connectors 7*f* in accordance with the thicknesses of the flanges 2 and 4.

In the embodiment shown in FIGS. 10A and 10B, when the upper plates 7*d*-1 and 7*d*-2 have the continuous arch-shaped surfaces 61 and 62 without the clearances 74 for the corresponding fastening bolts 6 and are placed on the head end surfaces of the pump-chamber fastening bolts 6, as similar to the structure shown in FIGS. 9A and 9B, the plate connectors can be disposed at easily fixable angular positions regardless of the angular positions of the pump-chamber fastening bolts 6.

In the embodiments shown in FIGS. 9A to 10B, although the pairs of upper and lower plates are connected with the plate connectors, three or more upper plates and the same number of lower plates may be connected by the corresponding number of plate connectors.

According to the present invention, as described above, since the auxiliary flange-fixing attachment fixedly fastens or cramps the pump flange and the vacuum chamber flange from the outer peripheries thereof, even in case that the turbo-molecular pump is broken and the pump-chamber fastening bolts are broken due to this damaging torque, the turbo-molecular pump is prevented from a falling accident.

Since each of the auxiliary flange-fixing attachments comprises an upper retainer for pressing the vacuum chamber flange from above; a lower retainer for pressing the pump flange from below; and a plurality of fastening screws for fastening the upper and lower retainers, and the upper and lower retainers cramp the two flanges from the outer, peripheries thereof and the contacting pressure on the abutting surface between the two flanges becomes larger, the more damaging torque is absorbed by the friction between the two flanges, whereby the risk of breaking the fastening bolts may be reduced.

Since the auxiliary flange-fixing attachments are fastened together with the pump flange and the vacuum chamber flange by the pump-chamber fastening bolts, the attachments only require a small space for the hooked portions thereof and may be easily fixed to the pump case whose flange projects little from its body part.

Since the auxiliary flange-fixing attachments comprise a plurality of split rings, which form one ring; and a plurality of split-ring connecting means for connecting the split rings so as to form a ring shape, and the plurality of split rings cramp the two flanges from the outer peripheries thereof, the attachments only require a small space for the hooked portions thereof and may be easily fixed to the pump case whose flange projects little from its body part.

Since the auxiliary flange-fixing attachments comprise a plurality of split rings, which form one ring; and a plurality of split-ring connecting means for connecting the split rings so as to form a ring shape, and the plurality of split rings cramp the two flanges from the outer peripheries thereof, the two flanges are fully surrounded by the auxiliary flange-fixing attachments, thereby preventing the turbo-molecular pump from falling.

Since the auxiliary flange-fixing attachment comprises a plurality of upper plates covering the vacuum chamber flange from above; a plurality of lower plates covering the pump flange from below; and a plurality of plate connectors for connecting the pluralities of upper and lower plates so as to sandwich the vacuum chamber flange and the pump flange therebetween, the components forming the auxiliary flange-fixing attachment may be easily made, and also the auxiliary flange-fixing attachment may be easily assembled to the two flanges after the pump and the chamber are built together, whereby it is easy to properly adjust the gap between the lower plates of the attachment and the pump flange or between the lower plates of the attachment and the heads of the fastening bolts.

Since the lower surfaces of the upper plates are placed on the upper surface of the vacuum chamber flange and the auxiliary flange-fixing attachment is suspended from and supported by the vacuum chamber flange, the auxiliary flange-fixing attachment may be prevented from vibration during an operation of the pump.

Moreover, the upper surfaces of the lower plates and the lower surface of the pump flange or the upper surfaces of the lower plates and the head end surfaces of the pump-chamber fastening bolts have a gap therebetween, and the gap is set equal to or greater than one thread pitch of the pump-chamber fastening bolts. With this structure, even when the pump-chamber fastening bolts are broken by the damaging torque, the pump absorbs the energy of the damaging torque while rotating due to the remaining energy of the torque without interfering with the vacuum pump, whereby the vacuum chamber may be prevented from being damaged.

What is claimed is:

1. A turbo-molecular pump comprising:

a main body;

a pump case for covering the main body;

a first flange integrally formed with the pump case for connection to a second flange integrally formed with a vacuum chamber;

a plurality of fastening bolts for fastening the first flange to the second flange; and clamping means for clamping the first and second flanges together by surrounding a portion of each of the first and second flanges.

2. A turbo-molecular pump according to claim 1; wherein the clamping means comprises an upper retainer for pressing an outer peripheral surface of the second flange in a first direction, a lower retainer for pressing an outer peripheral surface of the first flange in a second direction opposite to the first direction, and a plurality of fastening screws for fastening the upper and lower retainers together.

3. A turbo-molecular pump according to claim 2; wherein each of the upper and lower retainers is generally arch-shaped.

4. A turbo-molecular pump according to claim 1; wherein the clamping means is connected to the first and second flanges by the fastening bolts.

5. A turbo-molecular pump according to claim 1; wherein the clamping means comprises a plurality of split rings and a plurality of split-ring connecting means for connecting the split rings together to form a generally ring-shaped member for clamping the first and second flanges together from outer peripheries thereof.

6. A turbo-molecular pump according to claim 1; wherein the clamping means comprises a plurality of upper plates for covering the second flange from above, a plurality of lower plates for covering the first flange from below, and a plurality of plate connectors for connecting the upper and lower plates together so as to sandwich the first and second flanges therebetween.

7. A turbo-molecular pump according to claim 6; wherein the upper plates have lower surfaces disposed on an upper surface of the second flange so that the clamping means is suspended from and supported by the second flange.

8. A turbo-molecular pump according to claim 7; wherein each of the plate connectors comprises at least one abutment piece abutting against a side surface of the second flange so as to integrally connect the corresponding plate connector to the second flange.

9. A turbo-molecular pump according to claim 8; wherein the at least one abutment piece comprises a screw screwed into the corresponding plate connector so as to abut against the side surface of the second flange.

10. A turbo-molecular pump according to claim 7; wherein upper surfaces of the lower plates and a lower surface of the first flange are spaced apart at a distance equal to or greater than one thread pitch of one of the fastening bolts.

11. A turbo-molecular pump according to claim 7; wherein upper surfaces of the lower plates and end surfaces of the fastening bolts are spaced apart at a distance equal to or greater than one thread pitch of the fastening bolts.

12. In combination:

a turbo-molecular pump having a first flange;

a vacuum chamber having a second flange;

connecting means for integrally connecting the first flange to the second flange; and clamping means for clamping the first and second flanges together.

13. A combination according to claim 12; wherein the clamping means comprises a first retainer for pressing an outer peripheral surface of the second flange in a first direction, a second retainer for pressing an outer peripheral surface of the first flange in a second direction opposite to the first direction, and a plurality of fastening members for fastening the first and second retainers together.

14. A combination according to claim 12; wherein the clamping means comprises a plurality of split rings and a plurality of connecting members for connecting the split rings together to form a generally ring-shaped member for clamping the first and second flanges together from outer peripheries thereof.

15. A combination according to claim 12; wherein the clamping means comprises a plurality of first plates disposed on an upper surface of the second flange, a plurality of second plates disposed on a lower surface of the first flange, and a plurality of connecting members for connecting the first and second plates together so as to sandwich the first and second flanges therebetween.

16. A combination according to claim 12; wherein the connecting means comprises a plurality of bolts.

17. An apparatus for connecting a turbo-molecular pump to a vacuum chamber, the apparatus comprising:

a plurality of first connecting members for connecting a flange of the turbo-molecular pump to a flange of the vacuum chamber;

at least one first clamping member configured to engage with a surface of the flange of the turbo-molecular pump;

at least one second clamping member configured to engage with a surface of the flange of the vacuum chamber; and a plurality of second connecting members for connecting the first and second clamping members together when the first and second clamping members engage the surfaces of the respective flanges of the turbo-molecular pump and the vacuum chamber to thereby clamp the flanges together.

18. An apparatus according to claim 17; wherein each of the first and second clamping member is generally arch-shaped.

19. An apparatus according to claim 17; wherein each of the at least one first clamping member and the at least one second clamping member comprises a plurality of first and second clamping members.

20. An apparatus according to claim 17; wherein when connected together by the second connecting members, the first and second clamping members form a clamping structure for clamping the flanges so as to sandwich the flanges therebetween.

* * * * *